US010184272B2

(12) United States Patent
Lee

(10) Patent No.: US 10,184,272 B2
(45) Date of Patent: Jan. 22, 2019

(54) INSTALLATION-FREE RECHARGEABLE DOOR LOCKING APPARATUS, SYSTEMS AND METHODS

(71) Applicant: Dominick S. Lee, San Lorenzo, CA (US)

(72) Inventor: Dominick S. Lee, San Lorenzo, CA (US)

( * ) Notice: Subject to any disclaimer, the term of this patent is extended or adjusted under 35 U.S.C. 154(b) by 0 days.

(21) Appl. No.: 15/201,380

(22) Filed: Jul. 1, 2016

(65) Prior Publication Data

US 2017/0002586 A1 Jan. 5, 2017

Related U.S. Application Data

(60) Provisional application No. 62/187,318, filed on Jul. 1, 2015.

(51) Int. Cl.

| | |
|---|---|
| ***E05B 47/00*** | (2006.01) |
| ***E05B 45/06*** | (2006.01) |
| ***E05B 39/00*** | (2006.01) |
| ***G07C 9/00*** | (2006.01) |
| *E05B 17/00* | (2006.01) |
| *E05B 15/16* | (2006.01) |
| *E05B 17/10* | (2006.01) |

(52) U.S. Cl.

CPC ..... *E05B 47/0012* (2013.01); *E05B 39/00* (2013.01); *E05B 45/06* (2013.01); *G07C 9/00571* (2013.01); *G07C 9/00817* (2013.01); *G07C 9/00944* (2013.01); *E05B 15/1607* (2013.01); *E05B 17/0083* (2013.01); *E05B 17/0091* (2013.01); *E05B 17/10* (2013.01); *E05B 47/0038* (2013.01); *E05B 2045/0635* (2013.01); *E05B 2047/0058* (2013.01); *E05B 2047/0062* (2013.01); *E05B 2047/0064* (2013.01); *E05B 2047/0067* (2013.01); *E05B 2047/0068* (2013.01); *E05B 2047/0069* (2013.01); *E05B 2047/0091* (2013.01); *E05B 2047/0095* (2013.01); *G07C 2209/08* (2013.01)

(58) Field of Classification Search

CPC ..... E05B 47/0012; E05B 39/00; E05B 45/06; G07C 9/00571; G07C 9/00817; G07C 9/00944

USPC ..... 340/5.7–5.74

See application file for complete search history.

(56) References Cited

U.S. PATENT DOCUMENTS

| | | | | |
|---|---|---|---|---|
| 2013/0132659 | A1* | 5/2013 | Odahara | G06F 15/7807 711/104 |
| 2013/0222136 | A1* | 8/2013 | An | G08B 13/2434 340/572.1 |
| 2015/0169494 | A1* | 6/2015 | Robertson | G06F 1/3203 710/104 |

* cited by examiner

*Primary Examiner* — Allen T Cao

(57) ABSTRACT

An installation-free rechargeable access control system is disclosed which automates the action of locking and unlocking a single-cylinder deadbolt on a door. In various embodiments, the present teachings provide a portable electronic module that can enhance the usage of deadbolts in place, instead of replacing the deadbolt mechanism itself. In various embodiments, the access control system can authenticate users and rotate a deadbolt using one or more peripheral sensing sources and wireless protocols.

14 Claims, 5 Drawing Sheets

INSTALLATION-FREE RECHARGEABLE DOOR LOCKING APPARATUS, SYSTEMS AND METHODS

RELATED APPLICATION

The present application claims a priority benefit to U.S. Provisional Patent Application No. 61/615,197, filed 2015 Jul. 1; incorporated herein by reference.

FIELD

The present teachings relate to the field of access-control systems for automating the locking and unlocking of single-cylinder deadbolts of doors of rooms and buildings. More particularly, the present teachings provide a portable electronic device for securely automating functions of an already-installed deadbolt mechanism.

INTRODUCTION

Traditional single-cylinder deadbolts are common locking mechanisms used worldwide to secure areas such as houses, buildings, rooms, and the like. The majority of such deadbolts are mechanical (non-electrical) and generally require a user to manually rotate the lock cylinder to secure a door. Typically, the lock cylinder can be rotated from one side of the door, e.g., from within the interior of a room or hallway, by revolving a turn-thumb. Similarly, the cylinder can be rotated from the other side of the door, e.g., from outside of a building or exterior to a room, by manually turning a removably-insertable key. Over the years, electronic locking devices have been developed that can automate the locking and unlocking of a deadbolt mechanism for a door. However, these devices typically require the complete replacement of an old or existing deadbolt apparatus. Further, such devices that have generally utilized only one or two authentication methods (e.g. RFID reader, keypad) that are locally present on the apparatus and thus is not convenient to switch to another authentication method.

The known electronic locking devices that can automate the locking and unlocking of a deadbolt mechanism for a door are generically referred to in the industry and among end-users as "smart locks". These devices have grown in popularity over recent years. Typically, a smart lock is regarded as an electromechanical lock that can perform locking and unlocking operations on the deadbolt mechanism of a door when it receives commands from an authorized mobile device using a wireless protocol and a cryptographic key. Such devices usually function with two main parts: A physical lock and an electrical system for user authentication. Wireless protocols that are commonly used for such applications include WIFI and BLUETOOTH. These protocols are used to authenticate users and communicate information between a smart lock and a portable device (e.g., smart phone, PDA, tablet, etc.). Smart locks are a key element of the ongoing wave of innovative smart-devices for homes, offices, and the like. It is notable that most smart locks in the current market are typically dependent on a user's smartphone. The user's smartphone typically communicates with a smart lock for authentication or configuration reasons. Unfortunately, without a smartphone, a Smart lock's functionality can be limited and, sometimes, even cease to operate.

Many smart lock devices today are able to lock and unlock a door through the command of a mobile device that possesses the same wireless compatibility and a preconfigured cryptographic key. A mobile device can acquire a particular cryptographic key through a mobile application designed for the smart lock which can look up a user on a database on the worldwide web. If the cryptographic key sent from the mobile device matches the preconfigured key on a smart lock, the deadbolt will either toggle to the lock or unlocked position. This implementation will work if a user has a mobile device with access to the internet as well as a cryptographic key assigned to the user in a database. Users without a cryptographic key assigned to a particular smart lock are not able to access the lock.

It is also notable that most if not all of the known smart locks require physical installation that involves complete replacement or half replacement of an old or existing deadbolt. This can be inconvenient for the owner since the old deadbolt must be removed and the new smart lock installed in its place. There are many types of deadbolts in the world. However, most smart locks sold commercially in the United States are only compatible with standard American deadbolts and they require installation. Additionally, if the old deadbolt is being replaced with a new smart lock, the user may not keep his/her physical keys. There have been a few exceptional instances of smart locks that allow the user to keep his/her existing keys. This was done, for example, by only replacing the inner half of the deadbolt, leaving the exterior intact. After the lock was installed, the user could still use existing keys while having smart lock functionality. However, even if the user was able to continue using his/her key, the user had to exert force to physically override the smart lock's motor mechanism. Unfortunately, there is no known solution for a smart lock that attaches on an existing deadbolt without prior installation. Unless specifically noted or clearly apparent otherwise in context, the term, "installation-free smart lock", as used herein, refers to an apparatus for use in combination with a pre-installed, existing deadbolt mechanism (e.g., a deadbolt mechanism already in-place in a door, "as is"), with the combination operable for smart lock-like functionality. That is, physical alteration or removal of a pre-installed, existing deadbolt mechanism of a door need be affected in order to achieve Smart lock-like functionality, such as previously mentioned.

Furthermore, if a user was to lock or unlock the deadbolt from the interior (e.g. inside a room or hallway), he/she would have to physically turn the deadbolt with his/her hand. Smart locks currently do not offer any means to automate the smart lock in the action of locking and unlocking from the interior. Many known smart lock devices are also unable to sense and automatically lock the door when the user leaves the premises.

Current smart locks usually run on alkaline or lithium batteries, both which can consume resources from the environment. Additionally, when these batteries fail, the user is locked out. The use of such batteries mandates the complete replacement of the batteries after the power is depleted. Smart locks that utilize energy from storage that can be replenished through USB charging or certain energy harvesting methods are not present in smart locks in the current market.

SUMMARY

A non-limiting summary of various embodiments of the present teachings is set forth next.

According to various embodiments, with all mentioned features being present, operational, and/or able to function, simultaneously, in any combination, or alone, the present invention provides solutions to an installation-free keyless entry system for single-cylinder deadbolt locks. In various embodiments, solutions of the present teachings can be employed with a majority of the know deadbolt mechanisms, and at least about 80%, at least about 90%, at least about 95%, and in some embodiments, with substantially 100%, of the known single-cylinder deadbolt locks.

In various embodiments, the present teachings provide methods for a smart-lock apparatus to authenticate one or more users. In some embodiments, methods are provided for a smart-lock apparatus to identify another similar apparatus in a predefined proximity. Authentication performed by a smart-lock apparatus according to the teachings herein, can be supported, for example, by modular peripheral sources, wireless protocols, and the like. In addition to securing a door, in various embodiments, a user can configure the smart-lock device to monitor a variety of activities, such as temperature and occupancy through the modular peripheral sources, and to trigger preprogrammed events.

In accordance with various embodiments, the compatibility of this system is scalable, as it can be configured to support the external addition of various electrical modules with wireless protocols or modular peripheral sensing functionality. A user is not confined to no more than one or two authentication protocols, as with the known devices, but can use alternate protocols. In some embodiments, the user need not physically alter or replace his/her deadbolt lock to gain smart lock functionality. The smart-lock apparatus of the present teachings can be mounted over a pre-installed deadbolt lock, for example, using releasable attachment devices, such as magnets, e.g., neodymium magnets. In various embodiments, the smart-lock apparatus can include a responsive feature, sometimes referred to herein as "key assistance," which comprises an algorithm to detect micro-movements of the deadbolt so that the user also can readily lock and unlock the door with his/her existing physical key. The key assistance feature can propel the smart lock's motor to move in the same direction as the user's key. In various embodiments, this feature can detect the difference between whether the deadbolt lock is being picked or if a genuine key is being used. In a situation in which the deadbolt is being picked, in some embodiments, the smart-lock apparatus can be configured for one or more protective actions, such as shutting down the device, stopping the motor, alerting the owner, and/or emitting a siren or flashing a light. If the genuine key is being used, this feature can assist the user in the action of rotating the deadbolt in the desired direction. In various embodiments, the smart-lock apparatus can allow emergency access, for example, via an SMS text or email message containing an appropriate cryptographic key. In some embodiments, the smart-lock apparatus can unlock to a mobile device with a specific phone number. In this way, a user who needs urgent access is need not register for an active account on a smart lock web server and request for access rights. Instead, one-time access can be administered without any registration. In various embodiments, the smart-lock apparatus can be configured to lock the deadbolt when a user leaves the premises, and/or to automatically lock the deadbolt when the door is closed and/or upon being idle for a predefined amount of time. In a variety of embodiments, the smart-lock apparatus can be accessible to the visually impaired through, for example, an audible chime emitted when the door is locked or unlocked, and can be accessible to the hearing impaired, for example, through a glass-lit capacitive touch button. In accordance with various embodiments, the smart-lock apparatus can include a rechargeable power solution, for replenishing an energy-storage unit, e.g., battery, without removal or disposal of non-rechargeable devices, e.g., batteries. Moreover, the device can be recharged, for example, through a USB port or equivalent power supply. In various embodiments, the smart-lock apparatus can be recharged by plugging in a USB power supply, by using environmentally friendly methods such as solar, radio waves, and the like.

Some aspects of the present teachings relate to various embodiments of methods for a smart-lock apparatus, mountable, or mounted, alongside or adjacent to a dead-bolt apparatus. In various embodiments, for example, the smart-lock apparatus can be mounted adjacent to a dead-bolt mechanism that already-exists (i.e., has been pre-installed) in a door of a room or building. The smart-lock apparatus, in some embodiments, can be removably mounted against the door, using any suitable means. In various embodiments, for example, magnetic forces can be employed to secure the smart-lock apparatus adjacent to the dead-bolt mechanism of the door. In a variety of embodiments, magnets are formed in, or affixed to, the enclosure of the smart-lock apparatus, for use with a door comprising a metallic material to which the magnets will naturally adhere by way of magnetic forces (e.g., a door comprising a ferromagnetic material.) In other embodiments, the smart-lock can be used with a door comprising a material to which the magnets will not adhere by way of magnetic forces. In the latter instance, a relatively thin, planar ferromagnetic template, or medallion, can be attached to the door, as by way of screws, glue, or adhesives, in the vicinity of (e.g., about the perimeter of) the deadbolt mechanism. The magnets of the smart-lock apparatus can then adhere by magnetic forces to the ferromagnetic template or medallion. In various other embodiments, magnets can be secured to the door, such as by glue, adhesives, or double-sided tape, such that they present their ends of opposing polarity in a dispositional layout like the disposition of the magnets of the smart-lock apparatus. Upon bringing the magnets of the smart-lock apparatus in proximity to the magnets attached to the door, the two sets of magnets will naturally be attracted to one another. In this way, with the magnets sticking to each other in a sturdy fashion, a means is provided for attaching the smart-lock apparatus closely adjacent to, or against, the door for use with the dead-bolt mechanism.

In accordance with a variety of embodiments, a method is provided for locking and unlocking a door, using a smart-lock apparatus that includes a microcontroller, and a memory associated with the microcontroller. The microcontroller can be programmed for entering, and exiting, a so-called "configuration mode." When entered into the configuration mode, identifiers held in the memory for one or more peripheral devices used for authentication are permitted to be viewed, added, modified, and/or removed. In accordance with various embodiments, such a method can include the steps of: (a) setting the microcontroller into the configuration mode, (i) connecting a first peripheral device for electrical communication with the smart-lock apparatus; (ii) connecting a second peripheral device for data communication with the smart-lock apparatus; and then, (iii) using at least the second peripheral device, transmitting one or more registration authentication keys for storage in the memory. Subsequently, the method can further comprise the steps of: (b) exiting the microcontroller out from the configuration mode, (i) connecting a third peripheral device for data communication with the smart-lock apparatus; (ii) transmitting a login-in key to the third peripheral device; (iii) forwarding the transmitted log-in key, using at least the third peripheral device, to the microcontroller in the smart-lock apparatus; (iv) retrieving the one or more registration keys stored in the memory into the microcontroller; (v) comparing the transmitted log-in key against the one or more retrieved registration keys, looking for a match; and then, (vi) based upon the results of the comparing step, upon finding a match, unlocking the dead-bolt mechanism; and, optionally, opening the door.

In various embodiments of the foregoing method, at least two of the first, the second, and the third peripheral devices are no more than a single peripheral device (i.e., at least two of the three are one and the same device.) In a variety of embodiments, of the foregoing method, all of the first, the second, and the third peripheral devices are no more than a single peripheral device (i.e., they are all one and the same device.)

In various embodiments of the forgoing method, a further step of transmitting the registration authentication keys to a web server for publication.

In various embodiments of the forgoing method, wherein one or more of the peripheral devices is internet-enabled; and further comprising, responsive to a request by a user for the smart-lock apparatus to unlock an adjacent deadbolt apparatus, the step of transmitting to any one or more of the internet-enabled peripheral devices, via an SMS or email message, a time-limited, authorized login-key, then providing the login-key to the microcontroller, whereby the smart-lock device is operated for unlocking the deadbolt apparatus. In various embodiments of the forgoing method, further comprising, responsive to a request by a user for the smart-lock apparatus to unlock an adjacent deadbolt apparatus, the step of defining full access rights for a unique alpha-numeric string corresponding to the user or a portable device comprising an internet-enabled proxy for the user, which is operable by the user, in the database of a web-enabled server; transmitting to the user or the internet-enabled proxy for the user, via an SMS message, a time-limited, authorized login-key; and receiving, at the microcontroller, from the user via a peripheral device or from the internet-enabled proxy for the user, via the SMS message, the time-limited, authorized login-key, whereby the smart-lock device is operated for unlocking the deadbolt apparatus.

In various embodiments of the forgoing method, further comprising: automatically detecting the state of a selected deadbolt-lock mechanism, as being (i) "locked" or (ii) "unlocked," and, if the detected state is not the desired state, automatically changing the deadbolt-lock mechanism from the detected state to the desired state.

In various embodiments of the forgoing method, further comprising: within a defined range, detecting (a) the distance between a selected door and the location of a person; and (b) the side of the door facing the location of the person.

In various embodiments of the forgoing method, wherein the smart-lock can authenticate users under the absence of one or more of the following: Central server, Mobile phone, Accessory Attached.

In accordance with a variety of embodiments, a smart-lock apparatus is provided for tool-free mounting adjacent a turn-thumb, in which turn-thumb is rotatable about a first axis, of an already-installed deadbolt lock of a door, comprising of: (i) a housing, comprising plural sidewalls defining an internal chamber; wherein at least one of the sidewalls defines an opening and wherein at least one of the sidewalls defines at least one aperture; and further wherein a volume of a respective geometric shape defined by the perimeter of each aperture is less than a volume of a geometric shape defined by the perimeter of the opening; (ii) one or more magnets disposed at one or more respective positions of the sidewall that defines the opening; (iii) a microcontroller, and a memory associated with said microcontroller, supported within the housing; (iv) an accessory port, disposed for communication with the microcontroller, and accessible from outside the housing via said at least one aperture; (v) a motor supported within the housing, disposed for electrical communication with the microcontroller; and, (vi) a gripper mechanically linked to the motor for causing bi-directional rotation of the gripper about a second axis, as desired; wherein the gripper is disposed for engaging said turn-thumb, upon mounting said smart-lock apparatus, for inducing rotation of the turn-thumb, via rotation of the gripper by the motor.

In various embodiments of the forgoing apparatus, the magnets are neodymium magnets, can further comprise a double-sided adhesive on at least a portion of each neodymium magnet, and can further wherein the double-sided adhesive renders the neodymium magnets adherable to a surface of a selected door.

In various embodiments of the forgoing apparatus, the motor can be a servo motor, and can further comprise an auto-calibration subsystem for automatically calibrating the servo motor wherein the auto-calibration subsystem includes one or more sensors selected from the group consisting of rotational sensors, pressure sensors, or a combination thereof.

In various embodiments, the forgoing apparatus may comprise one or more sensors selected from the group consisting of rotational sensors, pressure sensors, or a combination thereof; wherein one or more sensors monitor rotation of the turn thumb for substantially constant rotational speed and smoothness, indicative that an authorized physical key is being manually employed for operation of the deadbolt mechanism, and further wherein said one or more sensors also monitor turn thumb, but for a lack of substantially constant rotational speed and smoothness, indicative that an unauthorized physical tool is being employed for picking the lock; wherein upon initially sensing rotation of the turn thumb for a short period in a fashion characterized by substantially constant rotational speed and smoothness, the motor can be actuated for facilitating or assisting with the manual rotation of the key; and further wherein upon initially sensing rotation of the turn thumb for a short period in a fashion characterized by a lack of substantially constant rotational speed and smoothness, means for defending the deadbolt against successful picking can be initiated.

In various embodiments, the forgoing apparatus further comprises one or more rechargeable batteries for receiving, storing, and supplying electrical power, within the housing; and an energy harvester comprising circuitry for harvesting energy from one or more energy sources, selected from the group consisting of: solar energy, radio frequency energy, kinetic motion energy, or any combination thereof; and wherein said energy harvester is configured for receiving energy for harvesting from one or more energy collection devices selected from the group consisting of: solar panel, radio frequency antenna, kinetic motion generator, or any combination thereof; and, further comprising charging circuitry configured to provide harvested energy to the one or more rechargeable batteries, whereby, in use, the one or more rechargeable batteries are maintained in a properly charged state.

In various embodiments, the forgoing apparatus further comprises one or more trigger mechanisms for activating a lock-state-change subsystem for causing the deadbolt mechanism to change between its "locked" and "unlocked"

states; wherein said one or more trigger mechanisms are selected from the group consisting of: a capacitive button, a tactile button, a reed switch, a reed magnetic sensor, a digital compass, or any combination thereof.

Other aspects of the present teachings relate to systems including a smart-lock apparatus. In accordance with a variety of embodiments, one such system can be provided for the automated control of one or more target electrical appliances. In various embodiments, such a system can comprise, for example: (i) a smart-lock apparatus comprising housing, and a microcontroller supported in the housing, a memory associated with the microcontroller, and an energy storage unit for receiving, storing, and supplying electrical power, within the housing; (ii) a first peripheral device connectable for electrical communication between the peripheral device and the energy storage unit; and, (iii) a second peripheral device and a transceiver, wherein the transceiver is supported by the peripheral device, and further wherein the transceiver is disposed for data communication with the memory; and, (iv) a programmable control subsystem for learning operational signal data for one or more appliances, wherein the subsystem comprises, for example, at least the transceiver, the microcontroller, and the memory associated with the microcontroller.

In various embodiments of the forgoing system, the first peripheral device and the second peripheral device can be the same peripheral device.

In various embodiments of the forging system, at least the first and second peripheral devices are connectable, simultaneously.

In various embodiments, the system can include a wireless modular peripheral or sensor connected to the smart-lock apparatus to recognize a particular user and send alpha-numeric messages to a separate wireless device such as a wireless appliance, vehicle, alarm system, garage door, and the like.

In various embodiments, a peripheral device, such as the second peripheral device, can comprise a wireless radio unit (e.g., WIFI radio unit) for internet connectivity and access. The peripheral device, in turn, can be configured for connecting the smart-lock apparatus (e.g., at the microcontroller board) to the internet; e.g., to send and receive data/information, and carry out various operations and functions. In this way, the smart-lock apparatus can integrate into an "Internet of Things" (IoT) and issue commands based upon defined parameters, upon certain triggering events, and the like.

In various embodiments, the system can comprise at least one aperture defined by the housing; an accessory port, disposed for communication with the microcontroller, and accessible from outside the housing via the aperture; an accessory port duplicator, connected to the accessory port; and one or more home-automation devices; wherein the port duplicator is adapted for communication with a respective controller for each of the one or more home-automation devices.

In various embodiments, the system can further comprise one or more additional smart-lock apparatus, each mounted at a respective pre-installed deadbolt mechanism of a respective door; and a communicator disposed in each of the smart-lock apparatus adapted for transmitting and receiving data signals; whereby any one of the smart-lock apparatus can communicate with any one or more of the other smart-lock apparatus.

BRIEF DESCRIPTION OF THE DRAWINGS

The present teachings will be illustrated by the following description in conjunction with the included drawings, in which.

DESCRIPTION OF VARIOUS EMBODIMENTS

Reference will now be made to various embodiments. While the present teachings will be described in conjunction with various embodiments, it will be understood that they are not intended to limit the present teachings to those embodiments. On the contrary, the present teachings are intended to cover various alternatives, modifications, and equivalents, as will be appreciated by those of skill in the art.

Figure 1:
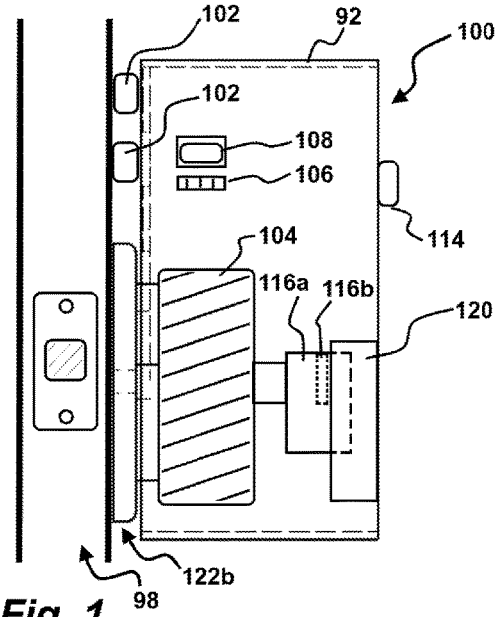
FIG. 1 is a side view of the a smart-lock apparatus mounted on a deadbolt, according to various embodiments.
Figure 2:
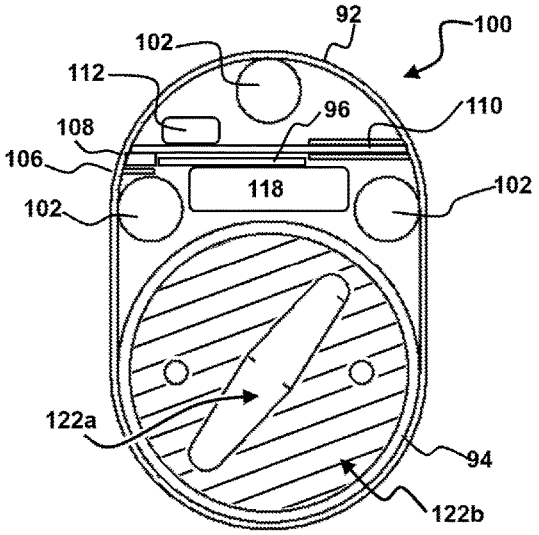
FIG. 2 is a cut-away top view of the smart-lock apparatus of FIG. 1, according to various embodiments.

In various embodiments, and with reference to FIGS. 1-2, the smart lock, designated generally by the reference numeral 100, comprises a housing, as indicated at 92. Housing, sometimes also referred to herein as an enclosure, 92 is configured to fit over an existing, pre-installed deadbolt mechanism, as shown generally at 122. Housing can comprise any suitable substantially rigid or rigid resilient, material, such as a metallic material, or a plastic material. In some embodiments, housing 92 is comprised of a non-metallic polycarbonate material. In other embodiments, housing 92 comprises a metallic material, such as aluminum or stainless steel. In a variety of embodiments, housing 92 features an Acrylonitrile Butadiene Styrene (ABS) plastic body, and, optionally, a polycarbonate cover, and screws that permit ready removal of sidewalls, as desired. Although the housing 92 is typically disposed at the interior side of a door, in various embodiments, the material should be able to withstand typical outdoor environmental conditions, as well as indoor conditions. In some embodiments intended for outdoor use, housing can define an interior water channel (not shown) for directing water, such as rain water, out of the unit. Further, smart locks intended for outdoor use can include one or more weatherproof gasket seals, as appropriate.

As can be seen in FIG. 2, in some embodiments, the circumference of the housing 92 can generally define an oblong shape, such as an oblong shape generally comprising a semi-circle at each of its distal end regions. No particular shape is required, as long as the housing is capable of housing the desired components and able to fit over the desired deadbolt mechanism with which it is intended to be used. For example, in some embodiments, rather than an oblong shape with semi-circular end regions, the housing could be rectangular, or it could have beveled edges, and so forth.

One or more magnets provides for magnet attachment, and ready detachment, as by hand or via a prying device, of housing 92 to a door 98 that includes an existing, pre-installed deadbolt mechanism 122 with which the smart lock 100 is intended for use. As shown, for example, in the side plan view of FIG. 2, circular end regions of three separate and distinct magnets, designated collectively as 102, can be seen, with one magnet disposed at the uppermost region of housing 92, and a magnet disposed at each respective lateral side portion of housing 92. Magnets 102 can be attached to housing by any suitable means. In some embodiments, portions of the housing define cylindrical cavities (not shown), each adapted to receive an elongate cylindrical magnet therein. Each magnet can be pressure-held within its respective cavity, and/or an adhesive or glue can be utilized to affix each magnet within its respective cavity. In accordance with various embodiments, each magnet comprises a miniature Neodymium (Nd) magnet. In some embodiments, the diameter of the magnets employed is selected to be within the range of from about 5 millimeters to about 15 millimeters (mm). For example, in some embodiments, each of three magnets employed with a smart lock comprises a diameter of about 10 millimeters. Further, while three magnets are depicted in FIGS. 1-2, the particular number and placement within the housing is not limiting, and any suitable number and placement of magnets can be employed. In some embodiments, four magnets are utilized, with one magnet towards each corner region of the housing. In a variety of embodiments, five or more magnets are utilized. The use of magnets, as described herein, impart what is referred to herein as an "installation-free" feature. In addition, or alternatively, such feature resulting from the use of magnets for attachment over an existing, pre-installed deadbolt mechanism can be thought of as "tool-free". It is appreciated that, in a sense, even by the use of magnets, strictly, the smart lock is nevertheless installed at a location over an existing, pre-installed deadbolt mechanism with which it is intended to be used.

As best seen in FIG. 2, and in accordance with various embodiments, a microcontroller board, or printed circuit board (PCB), designated by the reference numeral 110, can be supported inside housing 92. In some embodiments, microcontroller board 110 is permanently affixed inside housing 92. In various embodiments, microcontroller board 110 can be inserted into resiliently flexible clips (not shown) that support microcontroller board 110 in place, however, upon lifting of a clip, or applying a sufficient outward force at an end of microcontroller board 110, microcontroller board 110 can be "snapped" out. The latter provides modularity, such that any one of a variety of differing microcontroller boards 110 can be utilized inside housing 92 during active operational use, with any particular microcontroller board 110 chosen according to its suitability with a desired feature set for a specific installation. In various embodiments, microcontroller board 110 is simply is supported by wiring within the housing (e.g., it hangs freely from a connection point along such wiring.)

Microcontroller board 110 can include, for example, at least one microcontroller, or control unit, as well as a plurality of electronic parts, which can vary depending upon the specific functionality of any given smart lock, in accordance with the present teachings. A variety of standardized, off-the-shelf electronic parts can be employed with microcontroller board 110. Of course, custom-made parts can be utilized, as well. A person of ordinary skill in the art can determine appropriate electronic parts for accomplishing particular desired results, and can assemble them appropriately upon microcontroller board 110. In accordance with various embodiments, such electronic parts can include, for example, one or more of the following: resistors, capacitors, regulators (e.g., voltage regulators), and the like. In a variety of embodiments, alternatively, or in addition, such electronic parts can include, for example, one or more of the following: crystals, piezoelectric devices, switches, ports (e.g., USB ports, FIREWIRE ports, and the like), custom connector pins (herein referred to as an "accessory port"), serial drivers, wireless radios, and the like. In further embodiments, alternatively or in addition, such electronic parts can include, for example, one or more of the following: a microcontroller, capacitors, resistors, crystals, voltage regulators, switches, USB or other ports, one or more custom connectors, e.g., a 4-8 pin connector, serial driver(s), wireless radios, and the like. Further, in various embodiments, one or more serial communication integrated circuits (IC) can be supported within housing, such as the IC that can be seen in FIG. 2, designated by the reference numeral 96.

According to various embodiments, a charging/energy harvesting circuit, as shown at 112 in FIG. 2, can be supported within housing 92 in relative proximity to microcontroller board 110. In various embodiments, charging/energy harvesting circuit 112 can include, for example, any one or more of the following components: charging regulator chip, buck converter chip, and be adapted for receiving energy from suitable collection devices, such as solar panels, radio frequency antennas, kinetic motion generators, or piezoelectric generators, and the like.

In relative proximity to both charging/energy harvesting circuit 112, and microcontroller board 110, a source for receiving, storage and retrieval of electrical power 118, can be supported within housing 92. In various embodiments, the charging/energy harvesting circuit 112 can be disposed for electrical connectivity to such source for receiving, storage and retrieval of electrical power 118, which can comprise a rechargeable energy source, such as one or more rechargeable batteries, as depicted at 118. The rechargeable battery 118 can be adapted for electrical communication with, for example, the microcontroller board 110 to provide power. In a variety of embodiments, power source 118 is rechargeable in place (i.e. does not require removal from the unit.) For example, source for storage and retrieval of electrical power 118 can comprise one or more Lithium-Ion and/or Lithium-Polymer batteries.

With continuing reference to FIGS. 1-2, housing 92 is dimensioned and configured to accommodate and hold, a number of internal components. In accordance with various embodiments, housing 92 can include one or more cutaway or punched-out portions, or through-holes, to permit ready access, for example, to one or more connectors, each of which can be rigidly positioned (optionally, adapted for removal and reinsertion, as desired) at a respective one of such through-holes, for mating with a connector of the same type, but of opposite gender, from outside the housing 92. For example, a user can attach or insert, for example, a male connector by hand to a female connector within housing 92 and conveniently presented for such connectability at a through-hole of housing 92. In this way, for example, functionality can be added or modified. There is no limit as to the type of connector than can be employed, only that it should be suitable to be received and supported within the housing 92 and compatible with the selected internal electronics employed. A particular connector, contemplated for use herein in a variety of embodiments, includes an accessory port, as shown at 106, in FIGS. 1-2. The accessory port 106 can comprise, for example, a multi-pin terminal connector. The number of pins can be selected for intended uses of a particular smart lock. In various embodiments, in general, it is contemplated that the female end of a 4/8 or a 3/4/8 terminal connector can comprise accessory port 106. In various embodiments, a suitable connector can be a female jumper pin connector, mini USB connector, or magnetic connector. There is no limit on the connector used, only that it matches the compatibility of the devices connected to accessory port 106 such as a modular input accessory 134*a*, reader accessory 134*b*, wireless accessory 134*c*, or USB device (i.e. a computing apparatus). Such devices connectable to the accessory port 106 can be adapted to communicate to the microcontroller to authenticate a user, to configure settings of the microcontroller board 110, and/or to upload firmware onto the microcontroller. Other suitable connectors can be employed, depending upon the particular functionality desired, and taking into account, for example, hardware and wiring compatibility.

Also shown in FIGS. 1-2, adjacent and above accessory port 106 is the female end of a universal serial bus (USB) port, as designated by the reference numeral 108. It should be noted that while the depicted configuration and relative spacing between the USB 108 port and accessory port 106 can be convenient in many, if not most, circumstances, there is no limitation contemplated herein as to the specific placement of either port. Rather, the local environment, needs of a user, and so forth, can help define, preferred port placements. The ports can be maintained in close proximity to one another, or they can be disposed distal from one another, as appropriate. Regarding the USB port 108, in particular, any size USB port can be utilized, configured with any desired pin configuration. As contemplated herein, a female USB port that is of a type among the most popular of USB types used with portable devices, such as mobile phones, small personal tablets, and the like, can be employed. In the illustrated embodiment of FIGS. 1-2, a USB port selected from among the smaller standard USB types is employed, at 108, such as a micro-USB port or a mini-USB port. In some embodiments, a FIREWIRE port is provided, in addition or an alternative to, the USB port 108. In further embodiments, ports for the employment of optical cabling can be utilized.

Figure 9:
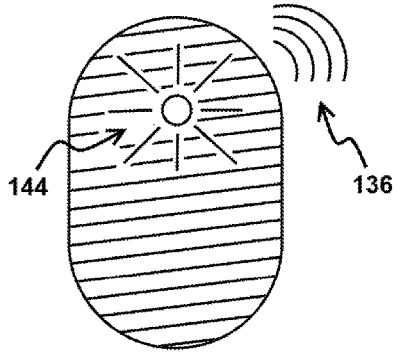
FIG. 9 is a top view of the smart-lock apparatus with qualities, according to various embodiments.

Referring now to FIGS. 1 and 9, a button, designated by the reference numeral 114, is provided projecting or extending outwardly from the major side or face of the smart-lock housing 92, oriented away from the deadbolt mechanism 122 over which the smart lock 100 is mounted. Button 114 can be of any know suitable type. In some embodiments, button 114 is a resilient, spring-loaded push button. Button 114 can be wired internally within housing 92 to the components for causing the deadbolt mechanism to "lock" or to "unlock," as desired. In various embodiments, button 114 comprises a physical tactile or capacitive button. A physical tactile button connects two or more electrical terminals together, while a capacitive button is a conductive area wired to circuitry that is responsible for detecting touch from a person or object with certain capacitive or capacitance. The smart lock 100, with button 114 presented for ready accessibility to a user, can be mounted, for example, interiorly of a building or room. For example, a physical tactile or capacitive button 114 can be used to unlock or lock a door from an interior location (e.g. inside a room or building). Button 114 (e.g., capacitive or tactile) can, according to various embodiments, trigger actuations that automatically lock or unlock the deadbolt 122 of a door 98.

It will be appreciated that smart lock 100 can include components and features to make it user-friendly for persons with disabilities, such as the hearing impaired and/or the visually impaired. With particular reference to FIG. 9, button 114 can be rendered readily accessible to the hearing impaired, such as in various embodiments wherein button 114 comprises a glass-lit capacitive touch button. In various embodiments, such a glass-lit capacitive touch button 114 can, according to various embodiments, trigger actuations that can automatically lock or unlock the deadbolt of a door. Moreover, in various embodiments, smart lock 100 can comprise a buzzer, ringer, bell, or the like (not shown), supported within housing 92. Smart lock 100 can be provided with a switchable mode (on/off) wherein, when active, upon (i) locking or (ii) unlocking of a door, an audible noise, such as a "chime" can be emitted (see sound-waves depicted at 136 in FIG. 9), thereby alerting a visually impaired person as to the locked or unlocked state of the door. The audible noise can differ between the two states, (i) locked and (ii) unlocked, for ready differentiation by the visually impaired user.

In a variety of embodiments, the smart lock includes a circular opening, designated generally by the reference numeral 94. The opening 94 is dimensioned and configured to maximize compatibility of the smart lock with the known deadbolt mechanisms. In various embodiments, for example, the circular opening 94 comprises a diameter selected within a range of from about 60 millimeters to about 70 millimeters. In some embodiments, the circular opening 94 comprises a diameter of about 65 millimeters. Of course, other, custom (i.e. non-universal), diameters and configurations can be employed, depending upon the particular deadbolt mechanism with which the smart lock is intended to be used.

Referring primarily to FIGS. 1-4, in a variety of embodiments of the present teachings, various contemplated smart-lock apparatus can comprise, for example, a plastic, metallic, or other suitable material housing, or housing 92. The housing 92 can have any suitable shape, such as a substantially elongated circle, and the like. The housing 92 can house, for example, at least any one or more of the following components: (i) One or more magnets, such miniature Neodymium magnets (e.g., approximately within a range of about 5~15 mm) 102; (ii) A PCB board or microcontroller board 110; (iii) A microcontroller or control unit; (iv) Typical electrical components commonly employed by those skilled in the art (e.g. resistors, capacitors, regulators); (v) Serial communication IC (integrated circuit) 96; An accessory port, such as a 4-8 terminal connector (106); A USB port 108, such as a micro or mini USB port; An illuminated capacitive button 114; A gripper, such as an open-ended knob 104; a motor, such as a servo motor 116; A mounting rail 120, e.g., for mounting the motor; An energy harvesting circuit 112; A rechargeable energy storage source, such as a Lithium-Ion or Lithium-Polymer battery 118; And, an accessory device, such as a modular accessory device 134, which can be used in connection with, for example, authentication.

Figure 3:
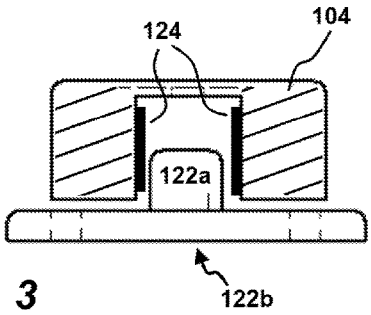
FIG. 3 is a side view of a gripping and turning mechanism of the smart-lock apparatus of FIG. 1, according to various embodiments.
Figure 4:
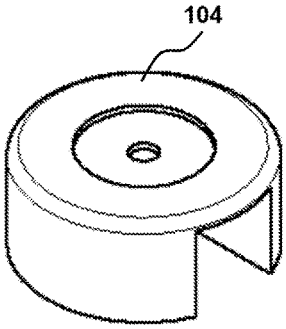
FIG. 4 is a perspective view of the gripping and turning mechanism shown in FIG. 3, according to various embodiments.

According to various embodiments, and with primary reference now to FIGS. 1, 3-4, a gripper mechanism, shown configured as an open-ended knob 104, can be seen in side view, in a generally upright, vertical orientation, substantially parallel and adjacent to, yet slightly spaced-apart from, a door 98 that includes an existing, pre-installed lock, with which the smart lock is intended to be used. Various embodiments contemplate that the gripper can take other forms. For example, in some embodiments, the gripper mechanism is a claw- or jaw-like device. In various embodiments, the gripper comprises a clamp-like device. In the depicted embodiment, a turn-thumb, shown at 122*a*, of an existing, pre-installed deadbolt mechanism 122 can be received within a cavity defined in open-ended knob 104, at a major side of open-ended knob 104 that faces towards the deadbolt mechanism 122 with which smart lock 100 is intended to be used. Cavity can comprise a square or rectangular shape aligned in the middle of the open-ended knob. The depth of the cavity can range from about 10 millimeters to about 30 millimeters, in order to partially or fully envelope the sides of turn-thumb 122*a*, as shown in FIG. 3.

Upon mounting smart lock 100 for operation, open-ended knob 104 can partially or fully envelope the turn-thumb 122*a* of deadbolt 122, as can be seen in the partial sectional view of FIG. 3, and allow the open-ended knob 104 to freely rotate in substantially the identical fulcrum of the turn-thumb 122*a*, thus unlocking or locking the deadbolt mechanism 122. At one major side of open-ended knob 104, facing away from the deadbolt mechanism 122 with which smart lock 100 is intended to be used, the center of open-ended knob 104 can be mounted to a precise rotary actuator with position feedback, such as a servo motor, denoted at 116*a* in FIG. 1. Servo motor 116*a*, can include an internal rotary potentiometer, also visible in FIG. 1, designated at 116*b*. In various embodiments, servo motor 116 can be adapted for vertical adjustability. In the illustrated embodiment of FIG. 1, for example, servo motor 116 can be vertically adjusted, as desired, on a mounting rail, designated by the reference numeral 120. For example, servo motor 116 can be secured at any one of various substantially vertically extending positions along mounting rail 120 using, e.g., a double-sided adhesive between the bottom of servo motor 116 and a surface of mounting rail 120. In some embodiments, servo motor 116 can be secured at any one of various substantially vertically extending positions along mounting rail 120*by* employing set-screws that can be inserted, for example, along the sides of mounting rail 120.

The partially sectional view of FIG. 3 shows turn-thumb 122*a* received within the cavity of open-ended knob 104, with smart lock 100 mounted for operation. In this mounted state, according to various embodiments, the position of the deadbolt's turn-thumb 122*a* can be substantially the same angular position as reported by the rotary potentiometer 116*b* of servo motor 116. Open-ended knob 104 can adapt to substantially the identical fulcrum of the deadbolt's turn-thumb 122*a* when servo motor 116 is vertically adjusted on the mounting rail 120, as by the vertical adjustment means described above. By this arrangement, the deadbolt mechanism 122 can be unlocked or locked by the rotation of servo motor 116. It will be appreciated that, instead of employing open-ended knob 104, as mentioned above, some embodiments contemplate the use of a jaw-like mechanism, a claw-like mechanism, or a clamp-like mechanism in substitution therefor.

In various embodiments, the smart lock can be manually mounted over a deadbolt lock, pre-installed in a door, by way of one or more magnets, such as neodymium magnets, attached to the smart lock, such as at 102 as shown in FIG. 1 and FIG. 2. Any suitable number and type of magnets can be utilized to securely maintain the lock in place for an indefinite period of time and against a variety of typical indoor or outdoor environmental conditions, yet allow for detachment, as by hand or via a prying device, in the event a user should desire to remove it. In some embodiments, three to eight magnets can be employed to hold the smart lock over the deadbolt lock. In various embodiments, it is contemplated that a door in which the deadbolt lock is pre-installed comprises, at least in part, a ferromagnetic metallic material suitable for magnetic attachment of the smart lock over the deadbolt apparatus. However, the present teachings are not limited to such metallic doors. For example, in an exemplary embodiment adapted for mounting of the smart lock on a non-metallic door (e.g. made of wood, composite, or other non-ferromagnetic material), the use of one or more double-sided adhesives can be applied to end regions of the magnets, in order that the smart-lock apparatus can adhere to a door via adhesives. Double-sided bonding tapes useful herein is manufactured, for example, by 3M Corp. (St. Paul, Minn.)

In a variety of embodiments, the smart lock can be mounted on top of a single cylinder deadbolt through its circular opening (with, e.g., a diameter of about from 60 millimeters to about 70 millimeters). As depicted in FIG. 1 and FIG. 3, an open-ended knob 104 can grip the turn-thumb 122*a* of the deadbolt 122 for rotation in substantially the identical fulcrum of the cylinder. The center of the open-ended knob 104 can be mounted to a precise rotary actuator with position feedback, such as a servo motor, shown at 116*a*. In a variety of embodiments, the open-ended knob 104 can be placed on over the deadbolt's turn-thumb 122*a*, as illustrated in FIG. 3. When so placed, the position of the deadbolt's turn-thumb 122*a* will substantially track the same angular position as reported by the rotary potentiometer 116*b*, which is located inside the servo motor 116. The open-ended knob 104 can adapt to substantially the identical fulcrum of the deadbolt's cylinder upon adjusting the servo motor 116 vertically along a mounting rail 120. The servo motor 116 can be secured at various positions on the mounting rail 120, for example, by using double-sided adhesive between the bottom of the servo 116 and mounting rail 120, or by using set-screws that can be inserted along the sides of the mounting rail 120. As illustrated in FIG. 2, a microcontroller on a PCB (printed circuit board) 110 can be secured alongside charging/energy harvesting circuit 112. The microcontroller PCB 110 can be comprised of components, including, but not limited to, capacitors, resistors, crystals, voltage regulators, switches, USB port 108, accessory port, such as custom 4-8 pin connector 106, serial driver, wireless radios, and the like.

With the intention that position tracking of a deadbolt's position may be advantageous, the position reported by the rotary potentiometer 116*b* can be logged by the microcontroller board 110 to determine the locked/unlocked status of the deadbolt. Pressure or force sensors 124, which vary proportionally in resistance when pressure is applied, can be attached to the inner sidewalls of the open-ended knob 124 (shown in FIG. 3) to detect the maximum and minimum angles of rotation of the deadbolt's turn-thumb. For example, during startup a procedure (sometimes referred to herein as "auto-calibration") can be performed to acquire the locked and unlocked angular positions by moving the servo motor 116 in a clockwise and counter-clockwise direction until the pressure sensors 124 reports a threshold of resistance, indicating the final locked or unlocked position. Advantageously, a user can place the smart lock on a door without the need to manually set the locking and unlocking positions of the deadbolt.

In a variety of embodiments, the smart lock apparatus can include a responsive feature, sometimes referred to herein as "key assistance," wherein an algorithm can detect micro-movements of the deadbolt so that the user also can easily lock and unlock the door with his/her existing key. In some embodiments, the key assistance feature can employ the previously-mentioned sensors (rotary potentiometer 116*b*, and pressure sensor 124) to detect pressure applied to the turn-thumb of a deadbolt. The sensors onboard (124 and 116*b*) can have capabilities such as rotational sensing, e.g., to the nearest degree. Key assistance can propel the smart lock's motor to move in the same direction as the user's physical key after it is inserted in the deadbolt and gently turned. In various embodiments, the microcontroller 110 can differentiate between unauthorized picking and use of a genuine key by detecting the sensed pattern of movement. For example, a valid key-turn can be detected in less than a second when the microcontroller collects over 50 samples of information and checks the rotation data for directional consistency. If the rotation data is not consistent and passes a threshold, the smart lock assumes the deadbolt is being lock-picked. In a situation in which the deadbolt is being lock-picked, according to various embodiments, the smart lock 100 can take protective actions such as shutting down the device, stopping the servo motor 116, alerting the owner through an attached modular accessory 134, and/or emitting a siren 136, flashing a light 114, and the like. If a genuine key is being used, the feature can assist the user in the action of revolving the deadbolt in the desired direction.

In various embodiments, the smart lock apparatus can include a rechargeable battery 118, operating, for example, in the range of 3-9 volts, such as lithium-polymer or lithium-ion as a power source. Rechargeable battery 118 can provide for recharging of the device, thus eliminating battery replacement and/or disposal, such as with single-use batteries.

Figure 5:
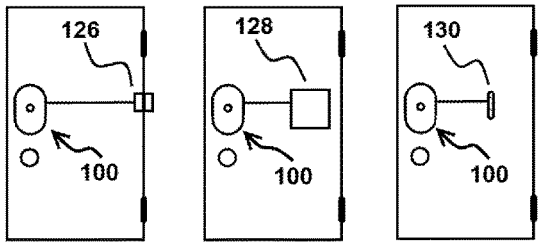
FIG. 5 illustrates various power configurations, according to various embodiments.

In various embodiments, the smart lock apparatus can be characterized by a low-power consumption, drawing, for example, 5-10 milliamp hours or less. In some such embodiments, the smart lock apparatus 100 can comprise an energy harvesting circuit, as depicted at 112. In various embodiments, the energy harvesting circuit can comprise a low-energy circuit that can replenish the power of the rechargeable battery 118 by extracting energy from a low-energy electricity source. Advantageously, the use of the energy harvesting circuit 112 can allow the smart lock to be powered by environmental means (shown in FIG. 5) such as solar power using a solar panel 128, wireless radio frequency using an antenna 130 to pick up energy, and door opening/closing motions by using a small generator 126, or other Faraday's law based means. Since the power terminals of the energy harvesting circuit 112 are disposed for electrical communication with the USB port 108, the smart lock 100 can be optionally powered by any USB power supply; e.g., a USB power supply exceeding 1000 mAh. This can provide for uninterrupted power.

Figure 6:
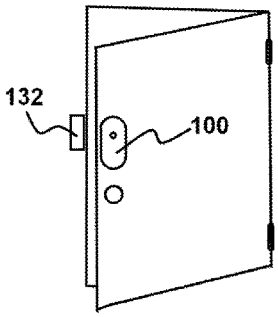
FIG. 6 illustrates various sensor configurations, according to various embodiments.

In various embodiments, the smart lock can include one or more features that automatically lock the door. One such exemplary feature, sometimes referred to herein as "auto-lock", can lock the deadbolt when a user leaves the premises by acquiring the state of a reed switch or hall-effect sensor in the device and mounting a magnet 132 adjacent to the smart lock, illustrated in FIG. 6. In a similar embodiment, this functionality can also be achieved by embedding a digital compass inside the smart lock which can relatively detect the current state of the door, e.g., when the door is in motion being opened, in motion being closed, or when it is still or idle. In various embodiments, a feature sometimes referred to herein as "auto-leave" can automatically lock the deadbolt after a predefined amount of time after a user triggers a physical tactile or capacitive button 114 on the apparatus 100. Moreover, in various embodiments, the Smart lock can be accessible to the visually impaired through an audible chime 136 emitted from an inbuilt buzzer when a door is locked or unlocked. In some embodiments, it can be accessible to the hearing impaired through a glass-lit capacitive touch button 114. The physical tactile or capacitive button 114 can be used to unlock or lock the door from the interior (e.g. inside a room or building).

Figure 7:
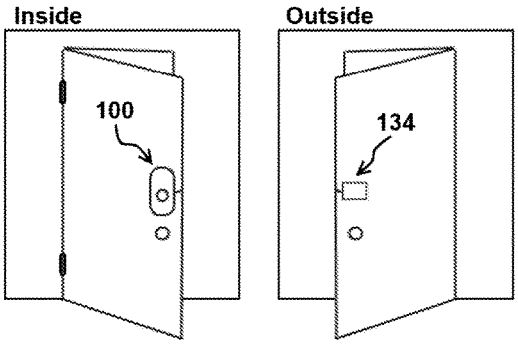
FIG. 7 is an illustration of typical usage, according to various embodiments.
Figure 8:
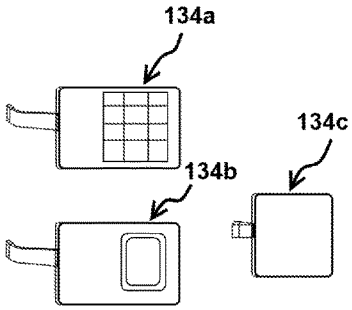
FIG. 8 illustrates various modular accessories, according to various embodiments.

In various embodiments, the smart lock comprises an accessory port, which, for example, can comprise a 4-8 pin modular connector 106. The accessory port 106 can comprise an electrical connector located on a side of the smart lock apparatus, shown in FIG. 1. The accessory port allows for modular sensor peripherals to communicate with the smart lock through analog signals, or digital signals such as I2C protocol, UART serial, and SPI protocol. For example, most temperature sensors and motion sensors can report sensor data through analog signals. In another example, most RFID readers 134*b* and magnetic stripe reader can communicate through UART serial. In another example, WIFI modules 134*c*, BLUETOOTH modules 134*c*, and other wireless radios can communicate with the I2C protocol. The first two pins of the accessory port 106 comprise of power wires (VCC and Ground) where the voltage is either identical to or regulated to a lower voltage than the operating voltage of the connected smart lock. In many microcontrollers (such as in the ATMEGA series, by Atmel, Inc.), certain input/output pins may have special functionalities. Sometimes, certain pins can perform multiple functionalities either simultaneously or alternatively. For example, a digital pin may become an interrupt, input, output, or pin with other functionality. With a chosen set of versatile pins grouped into an accessory port, the functionality the smart lock can be extended to allow authentication from external connected sources such as those aforementioned. For instance, upon connection of a peripheral sensing accessory, the smart lock can have the ability to authenticate users in various appropriate ways including but not limited to: a specific mobile device 140 (using WIFI accessory 134*c*), a BLUETOOTH-enabled vehicle driving near the smart lock (BLUETOOTH accessory 134*c*), an employee with a key-fob (RFID accessory 134*b*), a traveler with a credit card (magnetic stripe accessory 134*b*), an elderly family member (Fingerprint reader accessory 134*b*), a student living in a dorm-room with a cell phone (NFC reader accessory 134*b*), or a staff member (keypad accessory 134*a*). It should be noted that certain accessories that require physical human interaction for authentication (e.g. 134*a* and 134*b*) are referred to as "outdoor accessories", meaning they are intended to be mounted to the exterior of a door, such as shown in FIG. 7. Similarly, it should be noted that accessories that do not require physical human contact (e.g. 134*c*) and are typically smaller in size compared to outdoor accessories, are generally to be mounted adjacent to the smart lock 110 in the interior, such shown in FIG. 12. Optionally, sensing accessories that are not necessarily used for user authentication can be used, for example, as modular accessories. Sensors such as a temperature sensor, humidity sensor, vibration sensor 150, smoke detector, and the like, can be connected to the accessory port, for example, to display alerts and the status of a building to users who have access on the smart lock.

Figure 11:
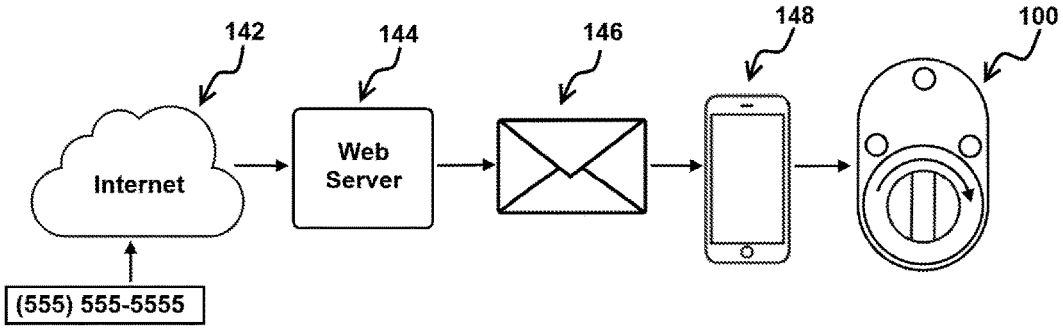
FIG. 11 is a block diagram with an illustration of an emergency access concept, according to various embodiments.

An unknown user with a mobile device, as at 148, who desires access is typically required to register for an active account on the smart lock web server, depicted at 144, and request for access rights. In certain situations, however, it is recognized that such registration and request may not be desirable, or feasible. For example, in various embodiments of the present teachings, the smart lock can comprise a system that allows near-instant access via an electronic message, such as an SMS text, email message, or electronic communication of any other suitable electronic messaging system, indicated generally by the reference numeral 146, containing a cryptographic key, such as shown in FIG. 11. In this way, a user with a mobile device 148 desiring urgent or emergency access need not register for an active account on the smart lock web server 144, and request access rights. Instead, limited, e.g., one-time, access can be administered without registration or association from the respective smart lock server. For example, such limited time period can be 5 minutes, 10 minutes, 15 minutes, 30 minutes, 1 hour, 12 hours, a day, a week, or a month.) In accordance with various embodiments, the foregoing can be achieved, for example, by the owner sending phone number information 142 to the smart lock server 144 to authenticate an unknown user's mobile phone. In other words, the owner can send a digital request 142 to the server 144 by specifying the user's phone number on the server's website or by electronic, e.g., SMS text, message. This number can be sent via the worldwide web (WWW) and recorded in the server database 144, as shown in FIG. 11. After the database has recorded the request, it can send an SMS or email message 146 to the respective user 148 whose phone number was specified. The message 146 can contain a time-sensitive cryptographic key that opens either a web browser or the smart lock application, or app, which unlocks the smart lock device 100 as desired. Although this implementation can be effective for smart lock owners with internet-accessible mobile devices, this embodiment can be extended to users without internet access on their mobile phone. Users with full access rights defined on the server's database may send SMS text messages 142 containing information about the smart lock they wish to unlock (e.g. lock name or identification number) to the central number of the smart lock. With the capability of the server parsing the text message contents as well as the phone number the message was sent from, the server can relay the command to the respective smart lock which is able to perform authentication to lock or unlock the door. This is useful for situations where a user does not have an internet data-plan on his/her mobile device but has the capability to access the internet inside a building via WIFI.

Figure 10:
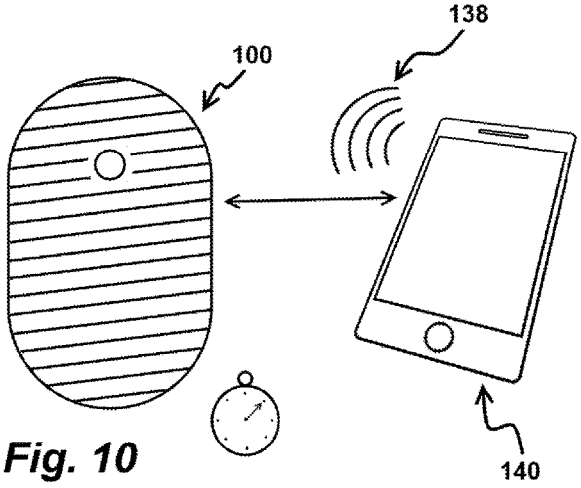
FIG. 10 illustrates the smart-lock apparatus of FIG. 9, establishing a wireless connection to achieve certain qualities, according to various embodiments.

In various embodiments, the smart lock may comprise a wireless modular accessory such as a BLUETOOTH, WIFI, or ISM frequency module by using the accessory port 106. Such accessories can be capable of transmitting and receiving signals such as cryptographic keys. However, the microcontroller board 110 can have a repetitive algorithm that detects a particular identification signal at a repeated interval and uses this to trigger actions. Should the microcontroller consistently receive a message 138 at a certain interval, it may be able to obtain more information about the wireless signal. This brings multiple advantages such as the ability to detect the presence, range, and identity of a certain device. For example, in a system where the smart lock 100 polls the accessory for incoming signal 138 every 5 seconds (shown in FIG. 10), the presence of a particular signal can trigger the smart lock to unlock the door. The duration of the polling can be changed to any interval from 10 milliseconds up to and including 1 minute. Likewise, the absence of signals can trigger the smart lock to lock the door or perform some other predefined action. This embodiment can be referred as "wireless proximity unlocking".

Figure 12:
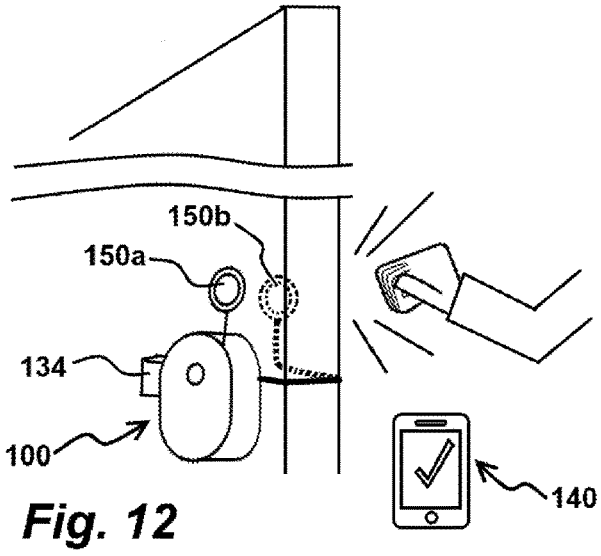
FIG. 12 illustrates the connection of vibration sensors in combination with a wireless modular accessory to the smart-lock apparatus, according to various embodiments.

In various embodiments, the smart lock apparatus can comprise an accessory that can detect the distance and side that a user is standing relative to a door through the combined use of existing wireless modular accessory 134 and vibration sensors 150. This embodiment, such as shown in FIG. 12, shows a vibration sensor accessory, such as two piezoelectric transducers 150, mounted on both sides of a door. When a user knocks on the surface of the door, for example, vibrations are delivered across the door to both sensors inside and outside the door. Through a comparative algorithm in the microcontroller 110 that recognizes the sensor (either 150*a* or 150*b*) with higher amplitude and speed, the system is able to detect which side of the door the user is on. Simultaneously, the system such as described immediately above (wireless proximity unlocking) can be used to detect the distance between a user and smart lock through the wireless signals transmitted. Such distance can be, in various embodiments, up to about 100 feet from the door. In some embodiments, such distance is up to about 35 feet from the door. In a variety of embodiments, the wireless direction is accomplished via a means employing a line-of-sight visualization technique. Given the estimated distance, the side of the user relative to the door, and the user's identity from the wireless transmission, the smart lock is able to unlock or lock the door for the user by a simple knock on the door without further interaction, shown in FIG. 12. Such embodiments, for example, can prevent an intruder from exploiting the embodiments relating to wireless proximity unlocking in the event a user with smart lock access leaves his/her wireless device in proximity to the door after entering a building. Since the smart lock will not unlock unless the wireless signal is transmitted simultaneously while the door is knocked upon from outside, the security of the wireless proximity unlocking is strengthened.

Figure 13:
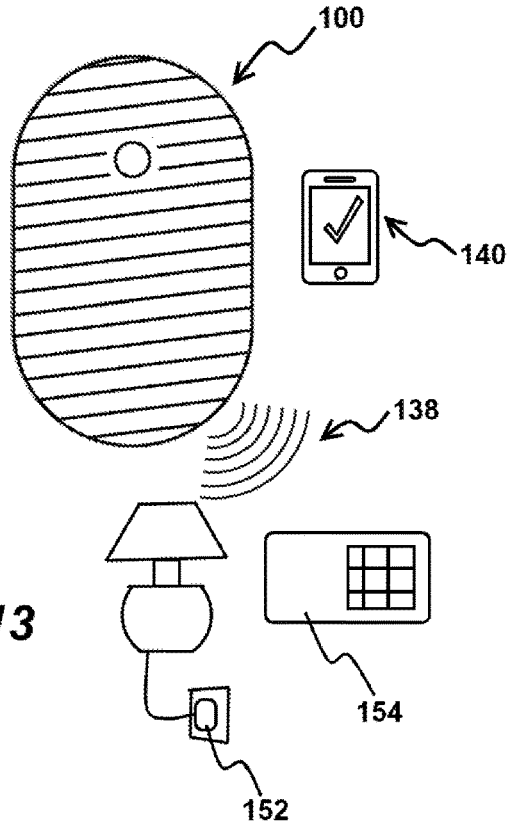
FIG. 13 is an illustration of the smart-lock apparatus using wireless connectivity to perform external tasks with other configured wireless devices, according to various embodiments.

In a variety of embodiments, a peripheral accessory 134*c*, which can be modular, can be connected to the accessory port 106 of a smart lock 100 to control a target electrical apparatus such as a lamp 152 or a security system 154, shown in FIG. 13. Additional target apparatus may include but not be limited to a thermostat, a robotic instrument, or a computer. Said modular peripheral accessory 134*c* can comprise a wireless device capable of communicating with said electrical apparatus comprising a casing, and wireless integrated circuit. Two or more wires, for example, can connect the wireless peripheral accessory 134*c* to the smart lock apparatus 100 to transfer electrical power and communication. In some embodiments, the smart lock 100 can be configured to receive wireless signals 138 reported from the modular peripheral accessory 134*c* and store said signals in the internal memory of the microcontroller board 110 for future use. This is useful, for example, if a user desires to configure the smart lock 100 to "learn" the wireless signal 138 emitted from a remote control (not shown) of said target electrical apparatus. "Learned" signals can be imitated by the smart lock 100 to control said target apparatus. Transmission of such signals can be triggered, for example, by at least one or more of the following events: user authentication, door open/closed, deadbolt unlocked/locked, or sensor activity on-board the smart lock. Furthermore, a list of wireless commands stored in the microcontroller 110 can be wirelessly retrieved by a mobile device (i.e. smartphone, PDA, laptop). Devices with access to this stored list can add, remove, and modify data in the list.

With reference now to FIG. 13, in various embodiments, the smart lock can perform functions or features that are prior or subsequent to locking or unlocking a door. Such features can enhance a user's lifestyle by running automated tasks when a user returns or leaves the premises. In various embodiments, target electrical appliances can be so-called, "Internet of Things" (IoT) devices, which can be devices configured to accept communication from, for example, the TCP/IP stack. In accordance with various embodiments, whether or not an IoT device is actively connected to the internet does not limit its functionality, provided the device can be wirelessly connected to the smart-lock apparatus. In various embodiments, command-specific messages, for example, can be relayed between the smart-lock apparatus and any one or more target electrical appliances to control the appliances.

In various embodiments, a peripheral device comprises a wireless radio unit (e.g., WIFI radio unit) for internet connectivity and access, which can be configured for connecting the smart-lock apparatus (e.g., at the microcontroller board) to the internet; e.g., to send and receive data/information, and carry out various operations and functions. In various embodiments, the smart-lock apparatus can be configured to control most IoT devices. Such functionality is imparted by components of the smart-lock apparatus, including a microcontroller, a connected wireless modular peripheral (e.g., a wireless transceiver operating in the range of 0.433-2.4 GHz), and a power source (i.e. a battery or power supply.) In general usage of the term, it might be said that IoT devices can be controlled by any device with a TCP/IP stack. In accordance with the present teachings, a wireless transceiver (which, in some embodiments, can be WiFi compatible) can be employed to connect the smart-lock apparatus to the internet. In a variety of embodiments, such TCP/IP stack need not be available or present for control of IoT devices. For embodiments contemplating IoT devices not actively connected to the internet, control in the home can be effected, for example, in situation wherein the IoT device(s) is/are inside the local network (i.e. WIFI or LAN network) in a proximity.

According to various embodiments, a "macro" is typically referred by those skilled in the art as a single instruction that expands automatically into a set of instructions to perform a particular task. Likewise, a single instruction (wireless transmission from a modular accessory 134) that expands automatically into a set of instructions (wireless transmissions from a modular accessory 134 to different devices such as 152 or 154) to perform a particular task will herein be referred to as a "macro". The present invention 100 is capable of executing macros that associate with a particular user's mobile device 140 or authentication method in the event a user is about to leave a building or enter a building such as giving reminders or turning on the lights 152. Appliances can be configured to be compatible with the smart lock by using generic wireless power outlets. The smart lock 100 can use a wireless accessory 134*c* to send identical signals that are normally sent by the corresponding remote control of the generic wireless power outlets. Security systems and home automation systems often offer an API (application programming interface) for other devices to interact with. Such APIs can be accessed by the smart lock through wireless modular accessories 134*c*. User-defined macros on the smart lock may be also reported to a home automation system 154 when available. Such macros may include but not be limited to turning on/off the lights 152, arming/disarming a security system 154, turning off the stove, sending a signal to locking/locking a vehicle, controlling a particular appliance, opening a specific website, placing an online order, starting a print job, etc.

In some embodiments, a microcontroller board 110 in a smart lock 100 can initially start in a mode (herein referred to as "configuration mode") that allows a user to add, modify, or remove access keys to the smart lock. An access key is a type of variable accessible to the microcontroller 110, and such variables can be referred to as strings, known to those skilled in the art. Strings are typically a sequence of characters, either as a literal constant or as type of variable. Elements of a string can be mutated and the length changed as long as it is below the maximum allocated memory of said microcontroller 110. An access key can originate from the signals sent from a modular peripheral accessory 134. When a smart lock 100 is in configuration mode, it listens for signals sent from a modular peripheral accessory 134 and stores incoming access data as an access key in the memory of the microcontroller 110. If a user desires, configuration mode can be manually elicited by a user sending a predefined command (e.g. "config") to the microcontroller board 110 through any communication protocol when the smart lock 100 is set in the unlocked state. Likewise, a user can escape configuration mode by sending the predefined command again. A smart lock 100 can store one or more access keys to gain one or more methods of user authentication. During normal operation (when the smart lock 100 is not in configuration mode), an access key sent to the device will elicit the microcontroller 110 to retrieve all stored access keys in memory to check for matches with the current access key sent. If a match is found, said smart lock 100 will unlock the door if it is locked or vice-versa.

Figure 14:
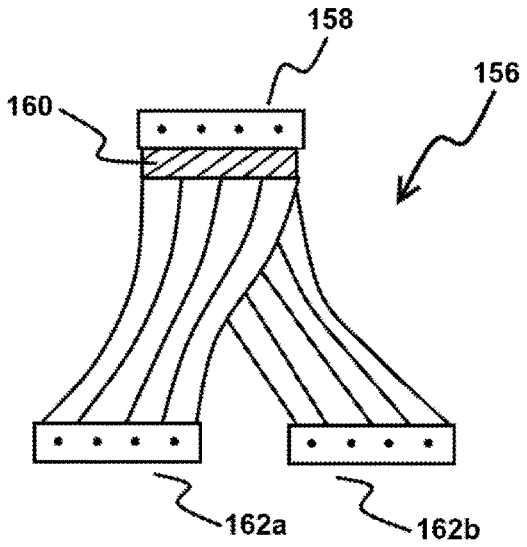
FIG. 14 is a perspective view of a splitter part for use in connection with a smart-lock apparatus, according to various embodiments; and, FIG. 15 illustrates a first smart-lock apparatus wirelessly communicating with other instances of like smart-lock apparatus through a modular accessory, according to various embodiments.

In various embodiments, the smart lock apparatus can be requested to run macros that communicate with more than one device. In an embodiment where modular peripheral accessories may be used for authentication or environmental automation, an accessory port may be duplicated into two or more accessory ports by connecting an accessory (herein referred to as a "port multiplier" 156) that can give respective priorities to both accessories, shown in FIG. 14. The port multiplier 156 allows two or more accessories 134 to connect to the single accessory port 106 on the smart lock 100 by offering additional ports 162. For example, those skilled in the art will appreciate that this can be done through the I2C protocol by assigning two different addresses to each peripheral sensing device or by using a multiplexer 160. Alternatively, those skilled in the art of shift registers 160 will appreciate that analog signals can be expanded through the method of addressing specific outputs or inputs. With this embodiment, users will enjoy the ability to configure the smart lock with macros that can run virtually simultaneously after a user is authenticated. For example, in one embodiment, the device can communicate with other automatic door devices such as a garage door or car door with the use of a wireless peripheral accessory connected to a port multiplier 156. The port multiplier 156 allows the use any user-preferred authentication method while being able to communicate with another accessory. Although the concepts aforementioned demonstrate the advantages of such technologies while present, the present invention is also able to maintain functionality of basic authentication in the absence of a central server 144, mobile phone 140, or accessory 134 attached. The smart lock 100 is able to operate as a stand-alone device as long as one authentication method is chosen and means to authenticate a user is available. For example, if phone authentication is chosen, then the phone must be able to provide the intended commands to authenticate a user (e.g. through WIFI, BLUETOOTH, or other mobile compatible means). In another instance, if a fingerprint accessory is connected, then the fingerprint sensor 134*b* must be mounted where a user is able to place his/her finger in order for the smart lock to perform as expected.

Figure 15:
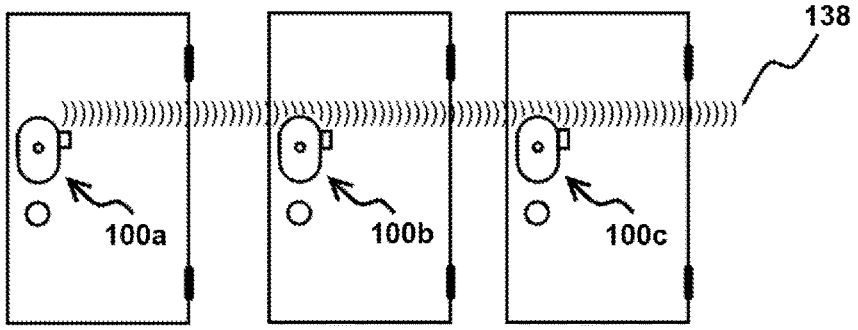

In another embodiment, a smart lock 100*a* is able to control other smart locks (100*b* and 100*c*) of the same kind. For example, if a building has multiple doors with the same kind of smart lock, the locks are capable of forming a network of communication 138 (assuming that all locks are using a compatible wireless accessory 134*c*), as shown in FIG. 15. This embodiment can be useful when a user wants to lock or unlock all doors simultaneously without the need to walk around a building. It can also be used to lock all doors in case of an emergency.

All references set forth herein are expressly incorporated by reference in their entireties for all purposes.

Those skilled in the art can now appreciate from the foregoing description that the broad teachings herein can be implemented in a variety of forms. Therefore, while the present teachings have been described in connection with various embodiments and examples, the scope of the present teachings are not intended, and should not be construed to be, limited thereby. Various changes and modifications can be made without departing from the scope of the present teachings.

It is claimed:

1. A method for a smart-lock apparatus magnetically mounted adjacent a dead-bolt apparatus for locking and unlocking a door, comprising a microcontroller, and a memory associated with said microcontroller, programmed for a configuration mode allowing viewing, adding, modifying, and removing identifiers held in the memory for one or more peripheral devices used for authentication:

(a) setting said microcontroller into the configuration mode, (i) connecting a first peripheral device for electrical communication with said smart-lock apparatus;

(ii) connecting a second peripheral device for data communication with said smart-lock apparatus; then, (iii) using at least said second peripheral device, transmitting one or more registration authentication keys for storage in the memory; and, (b) exiting said microcontroller out from the configuration mode, (i) connecting a third peripheral device for data communication with said smart-lock apparatus;

(ii) transmitting a log-in key to said third peripheral device;

(iii) forwarding the transmitted log-in key, using at least said third peripheral device, to the microcontroller in said smart-lock apparatus;

(iv) retrieving the one or more registrations keys stored in the memory into the microcontroller;

(v) comparing the transmitted log-in key against the one or more retrieved registration keys for a match; then, (vi) based upon the results of the comparing step, upon finding a match, unlocking the dead-bolt mechanism.

2. The method of claim 1, wherein at least two of said first, second, and third peripheral devices are no more than a single peripheral device.

3. The method of claim 1, wherein all of said first, second, and third peripheral devices are no more than a single peripheral device.

4. The method of claim 1, further comprising the step of transmitting the registration authentication keys to a web server for publication.

5. The method of claim 1, wherein one or more of said peripheral devices is internet-enabled; and further comprising, responsive to a request by a user for the smart-lock apparatus to unlock an adjacent deadbolt apparatus, the step of transmitting to any one or more of the internet-enabled peripheral devices, via an SMS or email message, a time-limited, authorized login-key, then providing the login-key to the microcontroller, whereby the smart-lock device is operated for unlocking the deadbolt apparatus.

6. The method of claim 1, further comprising, responsive to a request by a user for the smart-lock apparatus to unlock an adjacent deadbolt apparatus, the step of defining full access rights for a unique alpha-numeric string corresponding to the user or a portable device comprising an internet-enabled proxy for the user, which is operable by the user, in the database of a web-enabled server; transmitting to the user or the internet-enabled proxy for the user, via an SMS message, a time-limited, authorized login-key; and receiving, at the microcontroller, from the user via a peripheral device or from the internet-enabled proxy for the user, via the SMS message, the time-limited, authorized login-key, whereby the smart-lock device is operated for unlocking the deadbolt apparatus.

7. The method of claim 1, further comprising: automatically detecting the state of a selected deadbolt-lock mechanism, as being (i) "locked" or (ii) "unlocked," and, if the detected state is not the desired state, automatically changing the deadbolt-lock mechanism from the detected state to the desired state.

8. The method of claim 1, further comprising: within a defined range, detecting (a) the distance between a selected door and the location of a person; and (b) the side of the door facing the location of the person.

9. A smart-lock apparatus for tool-free mounting adjacent a turn-thumb, which turn-thumb is rotatable about a first axis, of an already-installed deadbolt lock of a door, comprising:

a housing, comprising plural sidewalls defining an internal chamber; wherein at least one of the sidewalls defines an opening; and wherein at least one of the sidewalls defines at least one aperture; and further wherein a volume of a respective geometric shape defined by the perimeter of each aperture is less than a volume of a geometric shape defined by the perimeter of the opening;

one or more magnets disposed at one or more respective positions of the sidewall that defines the opening;

a microcontroller, and a memory associated with said microcontroller, supported within the housing;

an accessory port, disposed for communication with the microcontroller, and accessible from outside the housing via said at least one aperture;

a motor supported within the housing, disposed for electrical communication with the microcontroller; and, a gripper mechanically linked to the motor for causing bi-directional rotation of the gripper about a second axis, as desired; wherein the gripper is disposed for engaging said turn-thumb, upon mounting said smart-lock apparatus, for inducing rotation of the turn-thumb, via rotation of the gripper by the motor.

10. The apparatus of claim 9, wherein said magnets are neodymium magnets; and further comprising a double-sided adhesive on at least a portion of each neodymium magnet; and further wherein said double-sided adhesive renders said neodymium magnets adherable to a surface of a selected door.

11. The apparatus of claim 9, wherein said motor is a servo motor; and further comprising an auto-calibration subsystem for automatically calibrating said servo motor; wherein said auto-calibration subsystem includes one or more sensors selected from the group consisting of rotational sensors, pressure sensors, or a combination thereof.

12. The apparatus of claim 9, further comprising one or more sensors selected from the group consisting of rotational sensors, pressure sensors, or a combination thereof; wherein said one or more sensors monitor rotation of the turn thumb for substantially constant rotational speed and smoothness, indicative that an authorized physical key is being manually employed for operation of the deadbolt mechanism, and further wherein said one or more sensors also monitor turn thumb, but for a lack of substantially constant rotational speed and smoothness, indicative that an unauthorized physical tool is being employed for picking the lock; wherein upon initially sensing rotation of the turn thumb for a short period in a fashion characterized by substantially constant rotational speed and smoothness, the motor can be actuated for facilitating or assisting with the manual rotation of the key; and further wherein upon initially sensing rotation of the turn thumb for a short period in a fashion characterized by a lack of substantially constant rotational speed and smoothness, means for defending the deadbolt against successful picking can be initiated.

13. The apparatus of claim 9, further comprising one or more rechargeable batteries for receiving, storing, and supplying electrical power, within said housing; and an energy harvester comprising circuitry for harvesting energy from one or more energy sources, selected from the group consisting of: solar energy, radio frequency energy, kinetic motion energy, or any combination thereof; and wherein said energy harvester is configured for receiving energy for harvesting from one or more energy collection devices selected from the group consisting of: solar panel, radio frequency antenna, kinetic motion generator, or any combination thereof; and, further comprising charging circuitry configured to provide harvested energy to the one or more rechargeable batteries, whereby, in use, the one or more rechargeable batteries are maintained in a properly charged state.

14. The apparatus of claim 9, further comprising one or more trigger mechanisms for activating a lock-state-change subsystem for causing the deadbolt mechanism to change between its "locked" and "unlocked" states; wherein said one or more trigger mechanisms are selected from the group consisting of: a capacitive button, a tactile button, a reed switch, a reed magnetic sensor, a digital compass, or any combination thereof.

* * * * *